US005765594A

United States Patent [19]

Collins et al.

[11] Patent Number: 5,765,594

[45] Date of Patent: Jun. 16, 1998

[54] HYDRAULIC CONTROL VALVE

[75] Inventors: David Collins, Burlington, Iowa; Helge Joergensen; Xavier Mabit, both of Sydals, Denmark; Carsten Christensen, Broager, Denmark

[73] Assignee: Danfoss A/S, Nordborg, Denmark

[21] Appl. No.: 626,477

[22] Filed: Apr. 2, 1996

[51] Int. Cl.[6] ..... F15B 13/06

[52] U.S. Cl. ..... 137/625.48; 91/464; 137/596.13

[58] Field of Search ..... 91/464; 137/596.13, 137/625.48

[56] References Cited

U.S. PATENT DOCUMENTS

| | | | |
|---|---|---|---|
| 4,782,859 | 11/1988 | Constantinian | 91/464 X |
| 4,981,159 | 1/1991 | Christensen | 137/625.69 |
| 5,235,809 | 8/1993 | Farrell | 60/445 |

*Primary Examiner*—Gerald A. Michalsky
*Attorney, Agent, or Firm*—Lee, Mann, Smith, McWilliams, Sweeney & Ohlson

[57] ABSTRACT

A hydraulic control valve for controlling flow between a pump, a hydraulic device, and a vessel containing hydraulic fluid. The control valve has an elongated valve slide which is slidably mounted in an elongated valve housing. The valve has three positions, a central neutral position, a float position axially offset in one direction from the neutral position and a constant pressure position axially offset in the opposite direction from the neutral position. In the neutral position, flow of hydraulic fluid to the hydraulic device is inhibited. In the float position, connection is such that a raised device, such as a hydraulically operated bucket, is lowered slowly by gravity until it rests on the ground or another object. In the constant pressure position, the valve connects pump pressure to the load sensing circuit to facilitate, for example, shaking of a bucket of a piece of earth moving equipment.

24 Claims, 2 Drawing Sheets

HYDRAULIC CONTROL VALVE

BACKGROUND OF THE INVENTION

This invention relates to hydraulic control valves, and in particular to a hydraulic control valve having a positionable valve slide disposed in a housing bore, with the valve slide being movable into three positions, each of which provides a different function.

In U.S. Pat. No. 4,981,159, which is assigned to the assignee of the present application, and the disclosure of which is incorporated herein by reference, there is disclosed a hydraulic control valve with means for sensing pressure. That valve is used widely by the owner, and is typically known as the "Danfoss Proportional Valve". It finds particular utility in many applications, such as operating hydraulic cylinders and motors, and has a short stroke for the valve slide. It can be operated either electronically, with a solenoid, or manually, as the particular utility dictates.

U.S. Pat. No. 5,235,809, the disclosure of which is incorporated herein by reference, discloses various hydraulic circuits for shaking a bucket of a piece of earthmoving equipment. The hydraulic circuitry is fairly complex in that regard, and the valve of the present invention provides a simpler, more direct means of shaking a bucket in order to have it completely emptied. In order to do so, there must be a constant high pressure at the bucket. The simple way of obtaining high pressure is by means of directing pump pressure in the load sensing conduit to allow a very quick reaction time by the hydraulic valves used for shaking.

SUMMARY OF THE INVENTION

Accordingly, the invention is directed to a hydraulic valve which comprises a valve housing having an elongated axial bore and an elongated valve slide which is slidable in the axial bore between a central neutral position, a float position axially offset in one direction from the neutral position, and a constant pressure position which is axially offset from the neutral position in an opposite direction from the float position. The slide includes means in the float position to connect the hydraulic actuator to a tank reservoir such that pressure on the hydraulic actuator is relieved. The slide further includes means in the constant pressure position to connect pump pressure to a load sensing conduit. Finally, the slide includes means in the neutral position to connect the load sensing conduit to the tank reservoir such that pressure in the load sensing conduit is relieved and also to preserve pressure applied to the hydraulic actuator.

In accordance with the preferred form of the invention, the valve includes an annular pump groove in the axial bore which is adapted to be connected to a pump to receive pressurized hydraulic fluid. First and second actuation grooves are located on opposite sides of the pump groove and are adapted for connection to a hydraulic actuator, such as a displaceable piston. First and second tank grooves are located on axially opposite sides of the pump groove and are adapted for connection to a reservoir for the hydraulic fluid, each tank groove being spaced a predetermined distance from a respective one of the actuation grooves. First and second fluid seals are provided in the bore, with each seal being located between one of the tank grooves and its respective actuation groove. The seals each comprise a collar having a width less than the predetermined distance between the tank grooves and their respective actuation grooves. Third and fourth fluid seals are also provided, located in the bore on opposite sides of the pump groove. First and second load sensing grooves are located on axially opposite sides of the pump groove and are adapted for connection to the pump.

In the preferred form of the invention, the slide has a pair of spaced, annular float grooves therein. The float grooves are located such that when the slide is in the float position, one of the float grooves connects the first actuation groove to the first tank groove and the other of the float grooves connects the second actuation groove to the second tank groove.

The slide also includes a first axial passage and a pair of spaced radial passages in communication with the first axial passage, the first radial passages being located such that in the constant pressure position of the slide, one of the first radial passages is connected to the pump groove and the other of the first radial passages is connected to the first load sensing groove. A second axial bore is also provided in the slide and also has a pair of spaced second radial passages in communication with the second axial passage. The second radial passages are located such that in the neutral position, one of the second radial passages is connected to the second tank groove and the other of the second radial passages is connected to the second load sensing groove.

In accordance with the preferred form of the invention, the first and second load sensing grooves are connected to one another in the housing. The second radial passages are also located such that in the float position, one of the second radial passages is connected to the second actuator groove and the other of the second radial passages is connected to the second load sensing groove.

In the disclosed form of the invention, the tank grooves are located on axially opposite sides of the actuation grooves. Similarly, the load grooves are located on axially opposite sides of the tank grooves.

The float grooves each have a width which is greater than the width of the first and second fluid seals. In the float position, therefore, fluid is allowed to pass from the actuation grooves to the tank grooves, relieving pressure on any hydraulic device actuated.

Means is provided for preventing communication of fluid to the actuation grooves when the slide is in the neutral position. This means comprises at least one of the fluid seals, in combination with an unapertured central portion of the valve slide.

In the disclosed form of the invention, the actuation grooves, tank grooves and load sensing grooves are annular. The axially passages and the radial passages in the valve slide comprise bores. The shapes of the various grooves and passages can change depending on the configuration of the hydraulic control valve.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
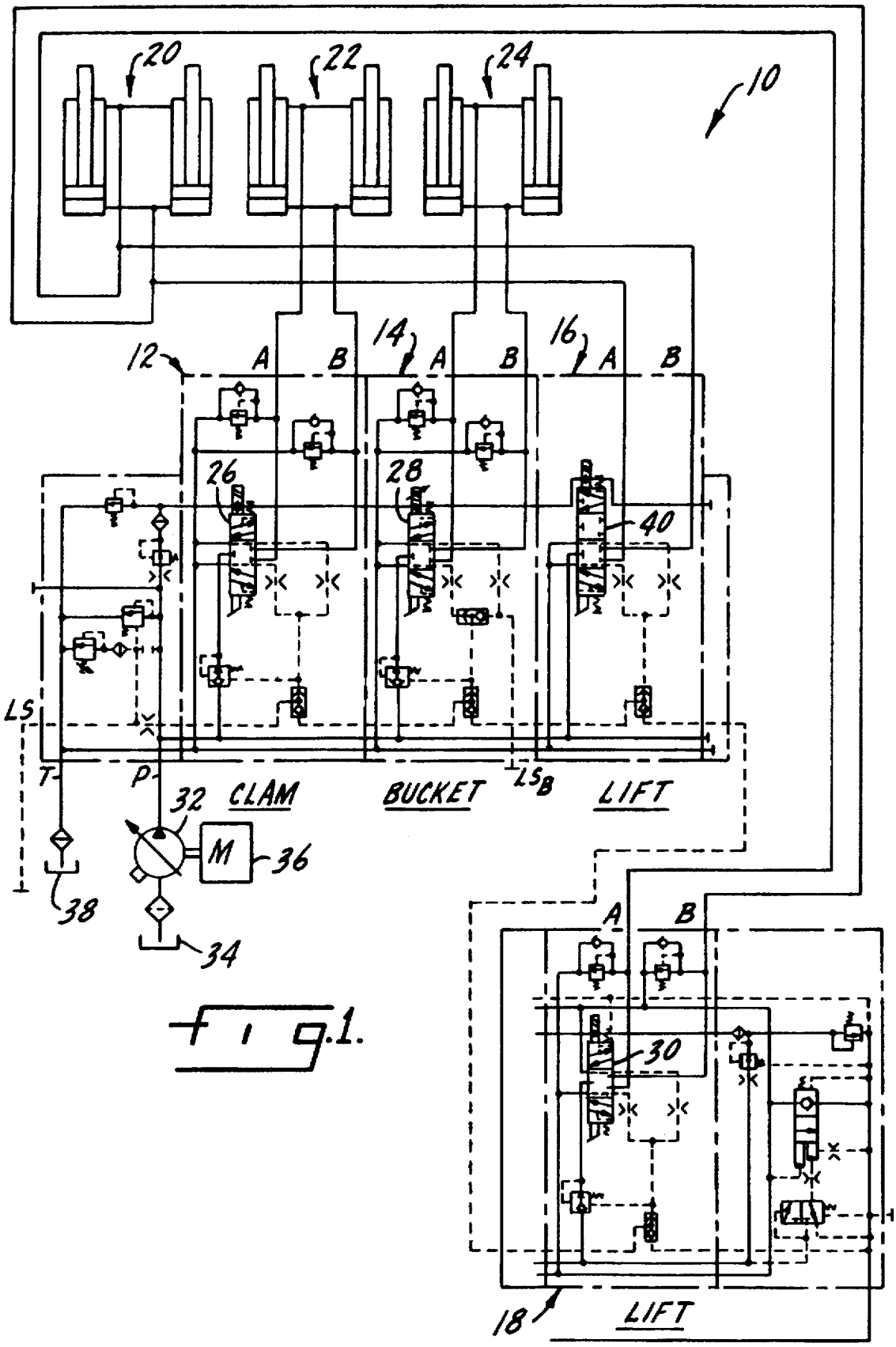
FIG. 1 is a schematic illustration of hydraulic circuitry for operating a backhoe loader, and including a hydraulic control valve according to the invention.

A hydraulic circuit for a backhoe loader or other similar type of earth moving equipment is shown generally at 10 in FIG. 1. The hydraulic circuit 10 employs several conventional elements which are illustrated, but not described in detail due to their being conventional. For example, illustrated are orifices, shuttle valves, and relief valves. These elements all operate in their typical, conventional fashions, and therefore are not described in detail.

The hydraulic circuit 10 includes a series of hydraulic sub-circuits 12, 14, 16 and 18. While four hydraulic circuits have been illustrated, and three of those hydraulic sub-circuits are shown together while a fourth is shown as a separate element, it will be evident to one skilled in the art that any number of hydraulic sub-circuits can be employed, depending on the apparatus being operated, and the hydraulic sub-circuits can be grouped together or formed separately, as needs dictate. The nature of formation of the hydraulic circuit 10 or the hydraulic sub-circuits 12 through 18 forms no part of the invention.

Each of the hydraulic sub-circuits 12 through 18 is connected to one of a pair of hydraulic actuators 20 through 24. For example, the hydraulic sub-circuit 12, which is depicted as operating a clam, is connected to the hydraulic actuators 22. Similarly, the hydraulic sub-circuit 14, which is designated as operating the bucket, is connected to the hydraulic actuators 24. The sub-circuits 16 and 18, which operate the lift for the bucket, may be connected to the hydraulic actuator 20. As will be evident to one skilled in the art, the actuators 20 through 24 may be connected to, and operate, other mechanical apparatus, and the designations as "clam", "bucket", or "lift", are arbitrary and are for simply purposes of description.

Each of the sub-circuits 12, 14 and 18 employs a respective hydraulic control valve 26, 28 and 30. The control valves 26 through 30 may be conventional, but preferably are Danfoss Proportional Valves made in accordance with incorporated U.S. Pat. No. 4,981,159.

Each of the hydraulic sub-circuits 12 through 18 has "A" and "B" lines leading therefrom to the hydraulic actuators 20 through 24. The designation of the lines as "A" and "B" again is conventional, with the lines "A" and "B" being connected to opposite sides of the pistons of the hydraulic actuators 20 through 24 in a conventional fashion.

Hydraulic fluid is provided to the sub-circuits 12 through 18 by means of a pump 32 which pumps hydraulic fluid through a pump line P. The pump 32 draws hydraulic fluid from a reservoir 34, and is driven by a motor 36. All of these elements may be conventional. The pump 32 may be a load sensing pump, therefore connected to the load sensing line LS, or can be a fixed displacement pump in an open center system such that excess hydraulic fluid is returned to the reservoir 34. Hydraulic fluid, after having been expelled from the various sub-circuits 12 through 18 after use, is returned via a tank line T to either a separate reservoir 38, or the reservoir 34. If a separate reservoir is employed, obviously the reservoirs 34 and 38 normally are interconnected so that hydraulic fluid constantly is re-used as the hydraulic circuit 10 is operated.

A hydraulic control valve 40, according to the invention, is shown as it is employed in the hydraulic sub-circuit 16. The hydraulic control valve 40 is illustrated in far greater detail in FIG. 2*a* through *c*, and its elements are now described.

Figure 2A:
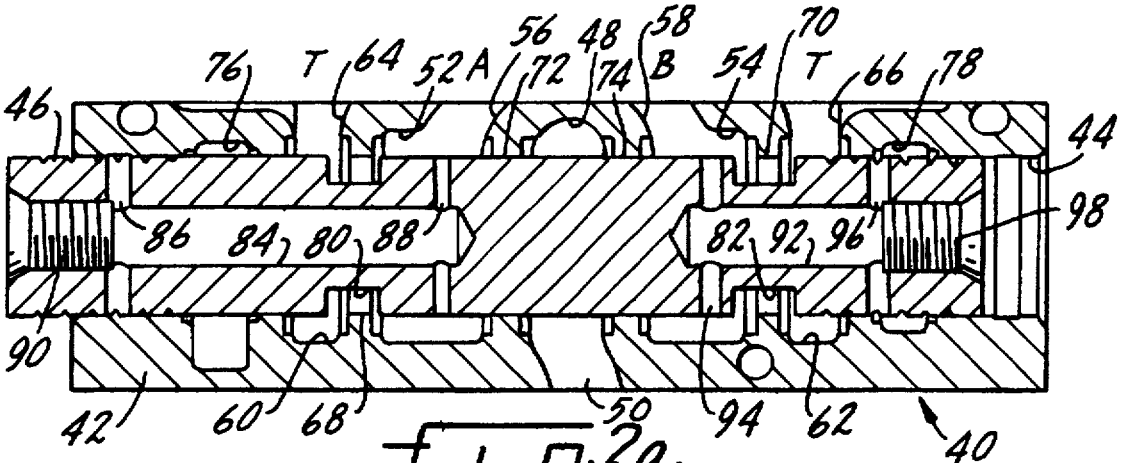
FIGS. 2*a* through 2*c* are a cross-sectional view of the hydraulic control valve according to the invention, showing the valve in the float position, neutral position and constant pressure position, respectively.

The hydraulic control valve 40 includes a valve housing 42 having an elongated axial bore 44. An elongated valve slide 46 is slidably mounted within the bore 44 and can be translated between three operative positions, a float position (FIG. 2*a*), a neutral position (FIG. 2*b*), and a constant pressure position (FIG. 2*c*). The positions and operation of those positions are described in greater detail below in relation to functions that can be performed when the valve slide 46 is located in the various positions.

The housing 42 is provided with a series of grooves in the axial bore 44. First is an annual pump groove 48, which is centrally within the housing 42, and which is connected to a conduit 50 supplied by the pump line P leading from the pump 32. On opposite sides of the pump groove 48 are respective first and second annular actuation grooves 52 and 54. The actuation grooves 52 and 54 are connected to respective conduits 56 and 58 leading to the respective hydraulic lines A and B which can be connected to the hydraulic actuator 20 (FIG. 1).

Respective first and second tank grooves 60 and 62 are located on opposite sides of the actuation grooves 52 and 54. Conduits 64 and 66 lead from the respective tank grooves 60 and 62, and are connected to the reservoir 38 (FIG. 1) for return of expended hydraulic fluid for re-use. As can be seen, the first tank groove 60 is separated from the first actuation groove 52 by a first fluid seal 68. Similarly, the second tank groove 62 is separated from the second actuation groove 54 by a second fluid seal 70. Each of the fluid seals 68 and 70 comprises a collar which has a width less than the distance separating the respective tank groove from the respective actuation groove.

Third and fourth fluid seals 72 and 74 are provided on opposite sides of the pump groove 48. Other fluid seals, not described in detail, can be provided elsewhere in the bore 44 or the slide 46 for appropriate sealing between the housing 42 and the valve slide 46.

First and second annular load sensing grooves 76 and 78 are located on axially opposite sides of the tank grooves 60 and 62. The load sensing grooves 76 and 78 are connected together in the housing 42 (means not illustrated) or outside the housing 42 (see FIG. 1) so that pressure in the grooves 76 and 78 is equal. The load sensing grooves 76 and 78 are connected to the load sensing line LS (FIG. 1). The load sensing line LS may be connected to the pump 32, as explained in U.S. Pat. No. 5,235,809, or the pump can be fixed displacement pump in an open center system which can supply the high pressure required with excess hydraulic fluid being returned to the tank reservoir 38.

The valve slide 46 has a pair of spaced, annular float grooves 80 and 82 formed therein. The function and location of the grooves 80 and 82 is described in further detail below.

The slide 46 also includes a series of internal passages. A first axial bore 84 is located in one end of the slide 46, having a pair of first radial bores 86 and 88 leading therefrom. After the bore 84 is formed, it is sealed with a permanent seal 90.

Similarly, the opposite end of the valve slide 46 is provided with a second axial bore 92. Second radial bores 94 and 96 extend from the second axial bore 92. A seal 98 is provided to seal the bore 92.

Figure 2B:
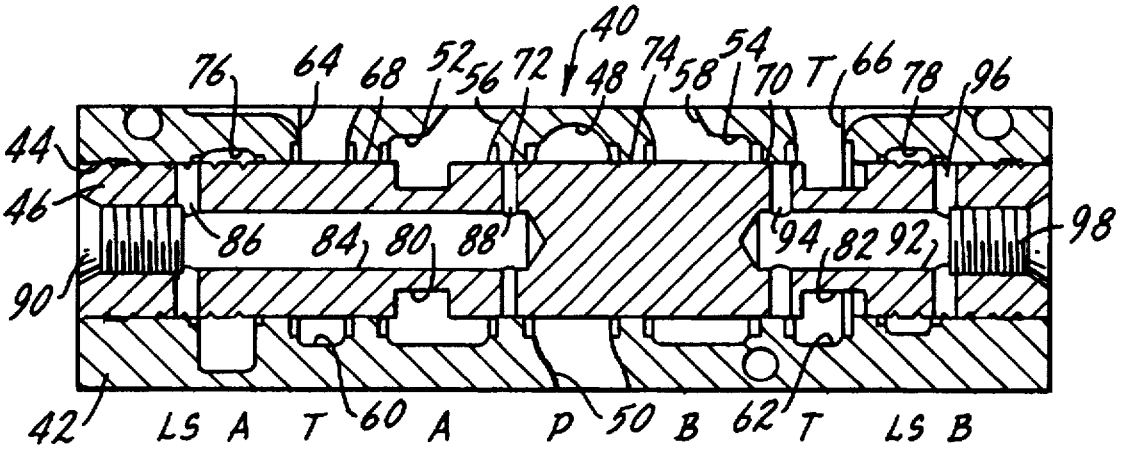
Figure 2C:
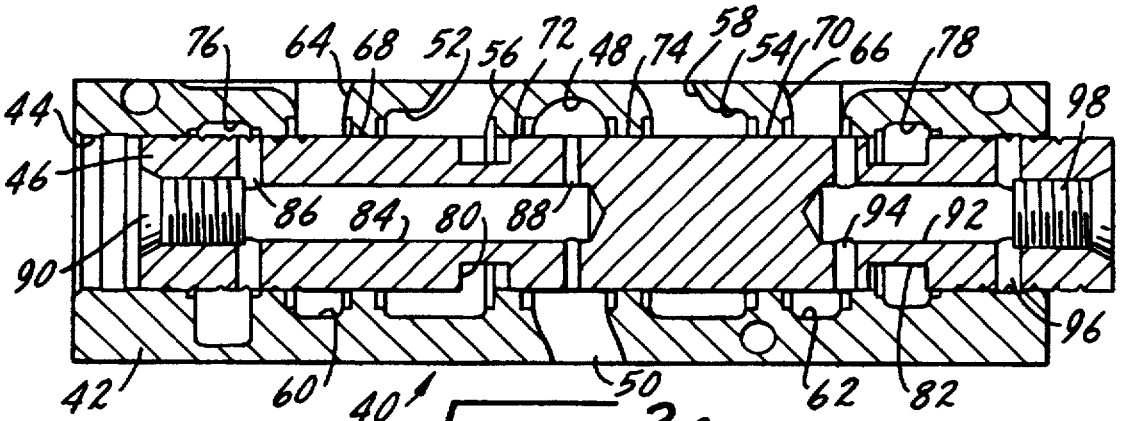

In the neutral position shown in FIG. 2*b*, the valve slide 46 is located centrally within the bore 44, as shown. The position of the slide 46 blocks any communication with the A conduit 56 or the B conduit 58, and therefore there can be no flow through these lines. However, in the orientation illustrated, the second radial bore 94 communicates with the tank groove 62, while the radial bore 96 communicates with the second load sensing groove 78. Thus, there is fluid communication between the load sensing groove and the reservoir, relieving any pressure in the load sensing groove 78 and therefore in the load sensing line LS (FIG. 1).

Because the two load sensing grooves 76 and 78 are interconnected, any pressure in the load sensing groove 76 would also be relieved, relieving any pressure within the first axial bore 84.

Also in the neutral position, the valve slide 46 blocks communication with the pump groove 48 to prevent pressure from pump being applied through the control valve 40.

In the float position, as shown in FIG. 2*a*, the valve slide 46 is axially offset to the left in relation to FIG. 2*b* and in relation to the neutral position shown in FIG. 2*b*. In this position, the pump groove 48 is still blocked, but as shown, the float grooves 80 and 82 bridge across the respective fluid seals 68 and 70, providing a direct fluid connection between the respective actuation grooves 52 and 54 on the one hand and the tank grooves 60 and 62 on the other. As illustrated in the drawings, the widths of the float grooves 80 and 82 are greater than the widths of the seals 68 and 70 so that this communication is provided. Thus, fluid pressure in the actuation grooves 52 and 54, and therefore in the conduits 56 and 58 (and hydraulic lines A and B) is therefore relieved through the tank line T to the reservoir 38. If the hydraulic control valve 40 is used to operate a piece of earth moving equipment, and assuming that it is operating the lift of that earth moving equipment, if the lift is raised, the cylinders of the actuator 20, under gravity, will slowly be displaced, lowering the lift until its bucket strikes the ground or rests on another surface. Thus, the control valve 40, in the float position, relieves pressure and allows any piece of hydraulic equipment to return to a rest position.

Also in the float position, as illustrated in FIG. 2*a*, the load sensing groove 78 is connected to the actuation groove 54 through the axial bore 92 and the two radial bores 94 and 96. Thus, any pressure in the load sensing groove 78 (and the load sensing groove 76, communicating therewith), will be relieved.

In the constant pressure position shown in FIG. 2*c*, the pump groove 48 is no longer blocked. As shown, the pump groove 48 communicates with the load sensing groove 76 (and therefore the load sensing groove 78) by means of communication through the radial bore 88, the axial bore 84 and the radial bore 86. Thus, pump pressure is supplied directly to the load sensing line LS. Therefore, in the constant position shown in FIG. 2*c*, a simple means of communicating high pressure to the load sensing line is provided. Communication with the tank lines and the actuation lines is prevented given the configuration of the valve slide 46 and its position in the axial bore 44.

The constant pressure position is particularly valuable when attempting to shake a bucket of a piece of earth moving equipment. Generally, two conditions must be fulfilled in order to achieve shaking of the bucket:

(1) The hydraulic system must be exposed to fully hydraulic pressure in order to achieve a quick response. This is accomplished by connecting pump pressure directly to the load sensing conduit LS.

(2) With hydraulic pressure on the load sensing line LS, the bucket must be made to perform a shaking movement.

Preferably, the hydraulic control valve 28 (and indeed, the valves 26, 30 and 40) are electrically activated, as illustrated, so that the valves can change positions rapidly. Valve positions are controlled by an electronic hydraulic digital controller (not illustrated). Thus, by sending a control signal (such as pulses) to the valve 28, a shaking function is obtained. Alternatively, shaking of the bucket can be performed as explained in greater detail in incorporated U.S. Pat. No. 5,235,809.

Various changes can be made to the invention without departing from the spirit thereof or scope of the following claims.

What is claimed is:

1. A hydraulic control valve for controlling at least one double acting hydraulic actuator, comprising a. a valve housing having an elongated axial bore, b. an elongated valve slide slidable in said axial bore between three positions comprising a central neutral position, a float position axially offset in one direction from said neutral position and a constant pressure position axially offset from said neutral position in an opposite direction from said one direction, c. said slide including means in the float position to connect the hydraulic actuator to a tank reservoir such that all pressure on the hydraulic actuator is relieved, d. said slide including means in the constant pressure position to connect pump pressure directly to a load sensing conduit, and e. said slide including means in the neutral position to connect said load sensing conduit to said tank reservoir to relieve pressure in said load sensing conduit and to preserve pressure applied to the hydraulic actuator.

2. A hydraulic valve according to claim 1 including an annular pump groove in said bore and adapted to be connected to a pump to receive pressurized hydraulic fluid.

3. A hydraulic valve according to claim 2 including first and second actuation grooves on axially opposite sides of said pump groove and adapted for connection to a hydraulic actuator, and first and second tank grooves on axially opposite sides of said pump groove and adapted for connection to a reservoir for hydraulic fluid, said means in the float position comprising said slide having a pair of spaced, annular float grooves therein, said float grooves being located such that when the slide is in the float position, one of said float grooves connects the first actuation groove to the first tank groove and the other of said float grooves connects the second actuation groove to the second tank groove.

4. A hydraulic valve according to claim 3 including at least one load sensing groove in said bore, and said means in the neutral position comprising said slide having an axial passage and a pair of spaced radial passages in communication with said axial passage, said radial passages being located such that in said neutral position one of said radial passages is connected to said second tank groove and the other of said radial passages is connected to said load sensing groove.

5. A hydraulic valve according to claim 4 in which said radial passages are also located such that in said float position said one of said radial passages is connected to said actuation groove and said other of said radial passages is connected to said load sensing groove.

6. A hydraulic valve according to claim 3 including means preventing communication of fluid to said actuation grooves when said slide is in the neutral position.

7. A hydraulic valve according to claim 6 including first and second fluid seals in said bore, each seal being located between one of said tank grooves and a respective actuation groove, said seals each comprising a collar.

8. A hydraulic valve according to claim 7 in which said means preventing communication comprises one of said fluid seals and an unapertured control portion of said slide.

9. A hydraulic valve according to claim 2 including at least one load sensing groove in said bore, and said means in the constant pressure position comprising said slide having a first axial passage and a pair of spaced first radial passages in communication with said first axial passage, said first radial passages being located such that in said constant pressure position one of said first radial passages is connected to said pump groove and the other of said first radial passages is connected to said load sensing groove.

10. A hydraulic valve according to claim 2 including at least one load sensing groove in said bore, and said means in the neutral position comprising said slide having an axial passage and a pair of spaced radial passages in communication with said axial passage, said radial passages being located such that in said neutral position one of said radial passages is connected to a tank groove and the other of said radial passages is connected to said load sensing groove.

11. A hydraulic control valve, comprising a. a valve housing having an elongated axial bore, b. an elongated valve slide slidable in said axial bore between three positions comprising a central neutral position, a float position axially offset in one direction from said neutral position and a constant pressure position axially offset from said neutral position in an opposite direction from said one direction, c. an annular pump groove in said bore and adapted to be connected to a pump to receive pressurized hydraulic fluid, d. first and second actuation grooves on axially opposite sides of said pump groove and adapted for connection to a hydraulic actuator, e. first and second tank grooves on axially opposite sides of said pump groove and adapted for connection to a reservoir for hydraulic fluid, each tank groove being spaced a predetermined distance from a respective one of said actuation grooves, f. first and second fluid seals in said bore, each seal being located between one of said tank grooves and the respective actuation groove, said seals each comprising a collar having a width less than said predetermined distance, g. third and fourth fluid seals located in said bore on opposite sides of said pump groove, h. first and second load sensing grooves on axially opposite sides of said pump groove and adapted for connection to said pump, i. said slide having a pair of spaced, annular float grooves therein, said float grooves being located such that when the slide is in the float position, one of said float grooves connects the first actuation groove to the first tank groove and the other of said float grooves connects the second actuation groove to the second tank groove, j. a first axial passage in said slide and a pair of spaced first radial passages in said slide in communication with said first axial passage, said first radial passages being located such that in said constant pressure position one of said first radial passages is connected to said pump groove and the other of said first radial passages is connected to the first load sensing groove such that pump pressure is applied directly to the load sensing groove, and k. a second axial passage in said slide and a pair of spaced second radial passages in said slide in communication with said second axial passage, said second radial passages being located such that in said neutral position one of said second radial passages is connected to said second tank groove and the other of said second radial passages is connected to said second load sensing groove.

12. A hydraulic valve according to claim 11 in which said first and second load sensing grooves are connected to one another.

13. A hydraulic valve according to claim 12 in which said second radial passages are also located such that in said float position said one of said second radial passages is connected to said second actuation groove and said other of said second radial passages is connected to said second load sensing groove.

14. A hydraulic valve according to claim 11 in which said tank grooves are located on axially opposite sides of said actuation grooves.

15. A hydraulic valve according to claim 14 in which said load sensing grooves are located on axially opposite sides of said tank grooves.

16. A hydraulic valve according to claim 11 in which said load sensing grooves are located on axially opposite sides of said tank grooves.

17. A hydraulic valve according to claim 11 in which said float grooves each have a width greater than the widths of said first and second fluid seals.

18. A hydraulic valve according to claim 11 including means preventing communication of fluid to said actuation grooves when said slide is in the neutral position.

19. A hydraulic valve according to claim 18 in which said means preventing communication comprises one of said fluid seals and an unapertured control portion of said slide.

20. A hydraulic valve according to claim 11 in which said actuation grooves are annular.

21. A hydraulic valve according to claim 11 in which said tank grooves are annular.

22. A hydraulic valve according to claim 11 in which said load sensing grooves are annular.

23. A hydraulic valve according to claim 11 in which said axial passages each comprise an axial elongated bore.

24. A hydraulic valve according to claim 11 in which said radial passages each comprise a radial bore.

* * * * *